US008975547B2

(12) United States Patent
Shen

(10) Patent No.: US 8,975,547 B2
(45) Date of Patent: Mar. 10, 2015

(54) KEYSWITCH AND KEYBOARD INCLUDING THE SAME

(75) Inventor: Cheng-Hui Shen, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 202 days.

(21) Appl. No.: 13/612,202

(22) Filed: Sep. 12, 2012

(65) Prior Publication Data

US 2013/0334022 A1 Dec. 19, 2013

(30) Foreign Application Priority Data

Jun. 15, 2012 (TW) ..... 101211636 U

(51) Int. Cl.
*H01H 13/70* (2006.01)

(52) U.S. Cl.
USPC ..... 200/344; 200/5 A

(58) Field of Classification Search
CPC ..... H01H 3/125; H01H 13/14
USPC ..... 200/344, 5 A
See application file for complete search history.

(56) References Cited

U.S. PATENT DOCUMENTS

| | | | | |
|---|---|---|---|---|
| 5,705,275 | A * | 1/1998 | Nakano et al. | 428/413 |
| 7,265,310 | B1 * | 9/2007 | Wang | 200/344 |
| 2008/0273012 | A1 * | 11/2008 | Bullister | 345/169 |
| 2009/0260965 | A1 * | 10/2009 | Chang | 200/314 |
| 2011/0155552 | A1 * | 6/2011 | Wang | 200/344 |
| 2011/0220477 | A1 * | 9/2011 | Chen | 200/344 |

* cited by examiner

*Primary Examiner* — Renee Luebke
*Assistant Examiner* — Ahmed Saeed
(74) *Attorney, Agent, or Firm* — Michael A. Glenn; Perkins Coie LLP

(57) ABSTRACT

A keyswitch, disposed on a base plate, includes a keycap and a scissors-like supporting structure. The scissors-like supporting structure is disposed on the base plate and supports the keycap. The scissors-like supporting structure includes a first supporting member and a second supporting member. The first supporting member includes a first engaging shaft and a second engaging shaft respectively engaged with the base plate and the keycap. The second supporting member is pivotally connected to the first supporting member and includes a third engaging shaft and a fourth engaging shaft respectively engaged with the base plate and the keycap. A line connected between the centers of gravity of the first and second engaging shaft is not perpendicular to the first and second engaging shaft. A line connected between the centers of gravity of the third and fourth engaging shaft is not perpendicular to the third and fourth engaging shaft.

14 Claims, 9 Drawing Sheets

KEYSWITCH AND KEYBOARD INCLUDING THE SAME

RELATED APPLICATIONS

This application claims priority to Taiwan Patent Application Serial Number 101211636, filed Jun. 15, 2012, which is herein incorporated by reference.

BACKGROUND

1. Technical Field

The present disclosure relates to a keyswitch and a keyboard including the keyswitch.

2. Description of Related Art

A keyboard is an essential input device for inputting characters or numbers when using a personal computer. Consumer electronics used in daily life or large-scale processing equipment used in industry need input devices having keyswitch structures for operating the consumer electronics products and the processing equipment. Known keyswitch structures are generally classified into dome switches and rubber switches.

In order to balance the force that a user applies onto a keyswitch of a keyboard, a scissors-like supporting structure is typically disposed under a keycap of the keyswitch for guiding the keycap to move vertically. Therefore, the force can be evenly distributed on the keycap, regardless of whether the force is applied at an edge or a corner of the keycap, so that the keyswitch can be easily pressed and operated by the user.

Furthermore, a screen-printing technique is used to print characters on a conventional keyboard. However, the raw materials used in such printing cause environmental problems. Moreover, after long-term use, the printed characters become worn and are not easily recognized. To allow visibility when working in dark places, keyboards having LED (light-emitting diode) backlights have been developed. A known configuration involves disposing each of the keyswitches of the keyboard (or each of the keyswitches thereof requiring visibility) on a light emitting-diode.

However, because the conventional illuminated keyboard includes structural components (e.g., a keycap, a scissors-like supporting structure, a linkage, etc.) provided in a stacked configuration, the problem of light leakage must be considered. In addition, the energy consumption and costs increase with the high number of light emitting-diodes used in such a conventional illuminated keyboard. Furthermore, the structural stacked components in the conventional keyboard are symmetric, and such a configuration blocks the light emitted from the light emitting-diodes that is directed toward the patterns on the keycaps, and thus the patterns are not easily recognized.

SUMMARY

In order to solve the problems of the prior art, the disclosure provides an improved keyswitch. The keyswitch adopts an asymmetric scissors-like supporting structure to provide support under a keycap, so that a certain portion (e.g., a corner of the keycap) is not occupied by the scissors-like supporting structure. Accordingly, the light emitted by a light source that is disposed at the bottom of the keyswitch is not obscured by the scissors-like supporting structure and can be transmitted to a pattern of a laser inside-engraving layer in a light pervious region of the keycap. Therefore, the display result of the pattern is visually appealing and easily recognized by users. Because the keyswitch adopts the asymmetric scissors-like supporting structure, the disclosure further improves the stability of the keycap during vertical movement by increasing the thickness of the keycap and the thickness of the scissors-like supporting structure, and additionally by disposing a linkage member for providing additional support to the keycap.

According to an embodiment of the disclosure, a keyswitch is disposed on a base plate. The keyswitch includes a keycap and a scissors-like supporting structure. The scissors-like supporting structure is disposed on the base plate and supports the keycap. The scissors-like supporting structure includes a first supporting member and a second supporting member. The first supporting member includes a first engaging shaft and a second engaging shaft. The first engaging shaft and the second engaging shaft are respectively engaged with the base plate and the keycap. A line connected between the centers of gravity of the first engaging shaft and second engaging shaft is not perpendicular to the axial direction of the first engaging shaft and the axial direction of the second engaging shaft. The second supporting member is pivotally connected to the first supporting member and includes a third engaging shaft and a fourth engaging shaft. The third engaging shaft and the fourth engaging shaft are respectively engaged with the base plate and the keycap. A line connected between the centers of gravity of the third engaging shaft and fourth engaging shaft is not perpendicular to the axial direction of the third engaging shaft and the axial direction of the fourth engaging shaft.

In an embodiment of the disclosure, the length of the first engaging shaft is larger than the length of the second engaging shaft. The length of the fourth engaging shaft is larger than the length of the third engaging shaft.

In an embodiment of the disclosure, the keycap has a light pervious region. Both of the first supporting member and the second supporting member have an inwardly recessed shape at a location corresponding to the light pervious region.

In an embodiment of the disclosure, the keycap has a light pervious region. The length of the third engaging shaft is smaller than the length of the first engaging shaft, and the third engaging shaft is closer to the light pervious region than the first engaging shaft. The length of the second engaging shaft is smaller than the length of the fourth engaging shaft, and the second engaging shaft is closer to the light pervious region than the fourth engaging shaft.

In an embodiment of the disclosure, a thickness of the keycap is larger than 1 mm.

In an embodiment of the disclosure, a thickness of the scissors-like supporting structure is larger than 1.3 mm.

In an embodiment of the disclosure, the keyswitch further includes a linkage member. The linkage member is engaged with the base plate and an edge of the keycap.

In an embodiment of the disclosure, the keycap comprises a laser inside-engraving layer, and the laser inside-engraving layer is located at the light pervious region.

In an embodiment of the disclosure, the laser inside-engraving layer includes a pattern, and the pattern is a number, a symbol, a word, or a graph.

The disclosure further provides an improved keyboard. The keyboard disposes a light source under a keycap, and the light emitted by the light source is not obscured by a scissors-like supporting structure and can be transmitted to a pattern of a laser inside-engraving layer in a light pervious region of the keycap, so that the display result of the pattern is visually appealing and easily recognized by users.

According to an embodiment of the disclosure, a keyboard includes a base plate, a light source, and a plurality of keyswitches. The base plate has a plurality of holes. The light source is disposed under the base plate, and is used for emitting light via the holes. The keyswitches are disposed on the base plate. Each of the keyswitches includes a keycap and a scissors-like supporting structure. The keycap has a light pervious region corresponding to the light source. The scissors-like supporting structure is disposed on the base plate and supports the keycap. The scissors-like supporting structure includes a first supporting member and a second supporting member. The first supporting member includes a first engaging shaft and a second engaging shaft. The first engaging shaft and the second engaging shaft are respectively engaged with the base plate and the keycap. A line connected between the centers of gravity of the first engaging shaft and second engaging shaft is not perpendicular to the axial direction of the first engaging shaft and the axial direction of the second engaging shaft. The second supporting member is pivotally connected to the first supporting member and includes a third engaging shaft and a fourth engaging shaft. The third engaging shaft and the fourth engaging shaft are respectively engaged with the base plate and the keycap. A line connected between the centers of gravity of the third engaging shaft and fourth engaging shaft is not perpendicular to the axial direction of the third engaging shaft and the axial direction of the fourth engaging shaft.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
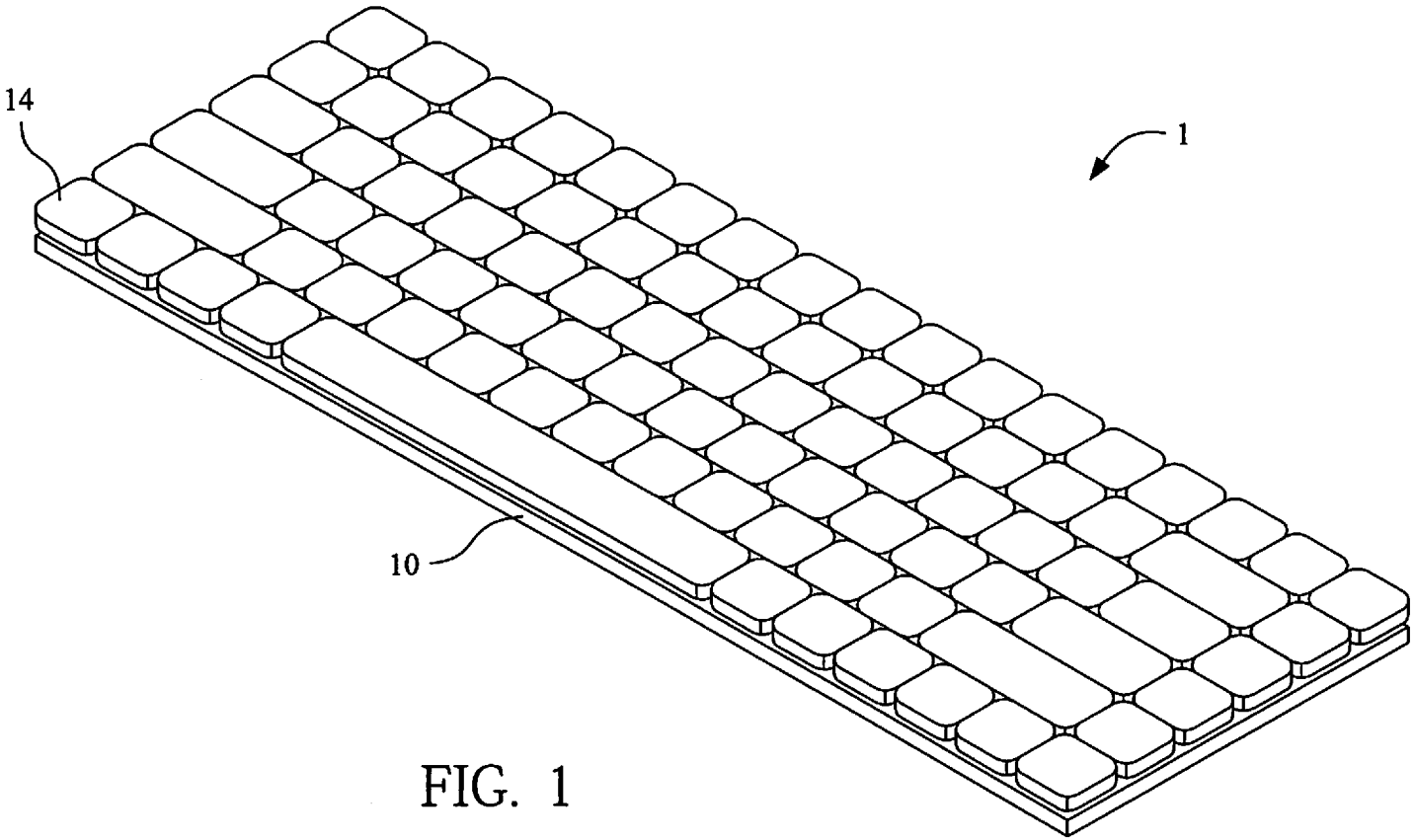
FIG. 1 is a perspective view of a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a perspective view of a keyboard 1 according to an embodiment of the disclosure.

As shown in FIG. 1, the keyboard 1 of the disclosure can be an external keyboard (e.g., a keyboard with a PS/2 interface or a keyboard with a USB interface) used in a desktop computer, or can be a part of a computer system having an input device that is in the form of a keyboard (e.g., a notebook computer or a laptop computer), but the disclosure is not limited in this regard. That is, the keyboard 1 of the disclosure can be used in any electronic product that adopts keyswitches to be the input interface. In particular, the concepts of the disclosure can be used in keyboards having scissors-like supporting structures.

As shown in FIG. 1, the keyboard 1 includes at least a base plate 10 and a plurality of keyswitches 14. The structures of components included in the keyboard 1 and connection relationships among the components are described in detail below.

Figure 2:
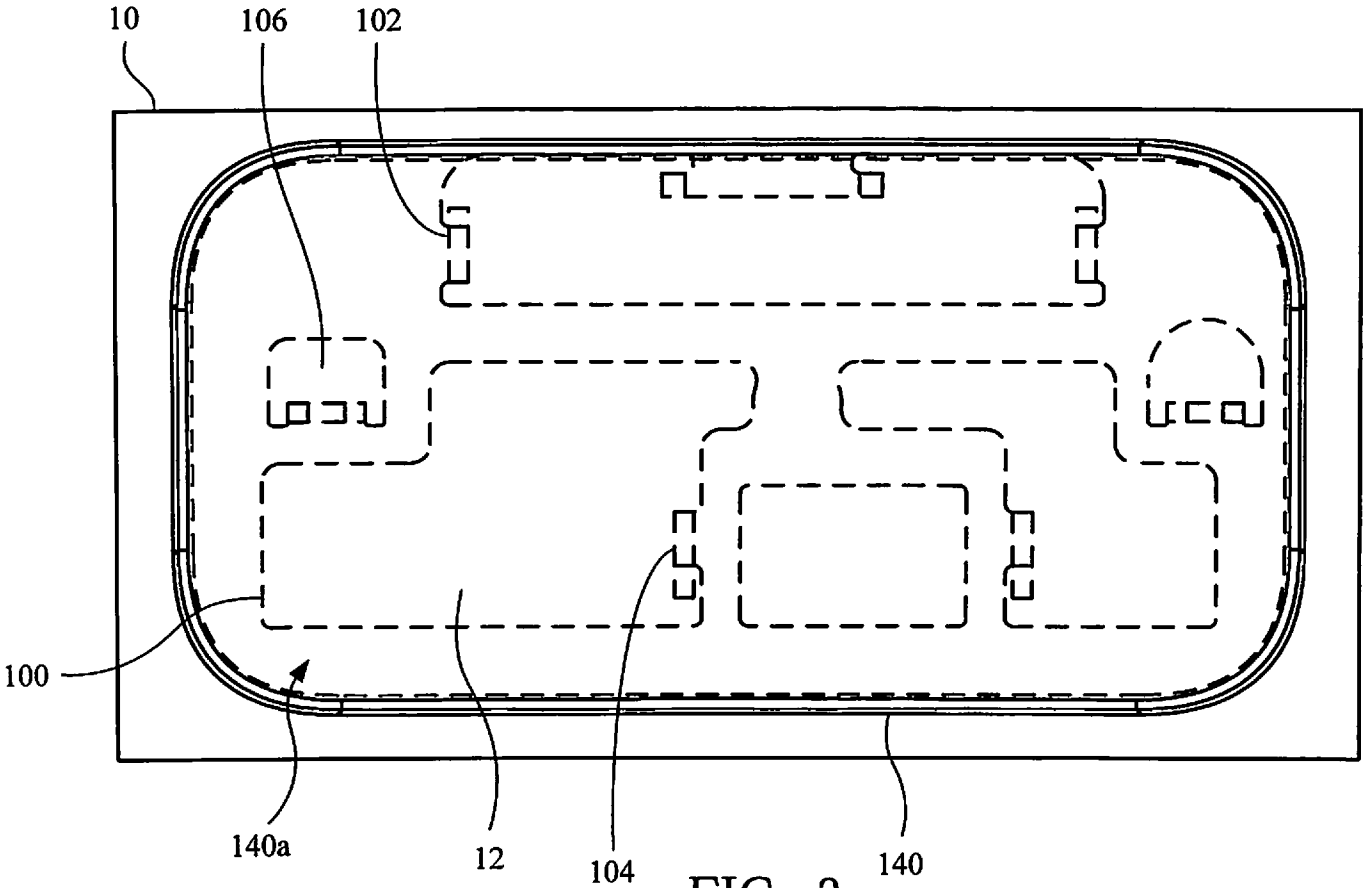
FIG. 2 is a top view of a keyswitch in FIG. 1, in which the contour of a base plate is indicated by dotted lines.

FIG. 2 is a top view of one of the keyswitches 14 in FIG. 1, in which the contour of a base plate 10 is indicated by dotted lines.

As shown in FIG. 2, the base plate 10 of the keyboard 1 has a hole 100. The keyboard 1 further includes a light source 12, and the light source 12 is disposed at an appropriate location under a keycap 140 for emitting light toward the keycap 140. The light source 12 can be located above or under the base plate 10. In the embodiment of the disclosure, the light source 12 of the keyboard 1 is disposed under the base plate 10 and emits light via the hole 100 of the base plate 10. The keyswitch 14 includes the keycap 140, and a corner of the keycap 140 has a light pervious region 140*a* (i.e., the lower left corner of the keycap 140 in FIG. 2 has the light pervious region 140*a*). The light pervious region 140*a* is aligned with the light source 12 which is disposed under the hole 100 of the base plate 10.

Figure 3:
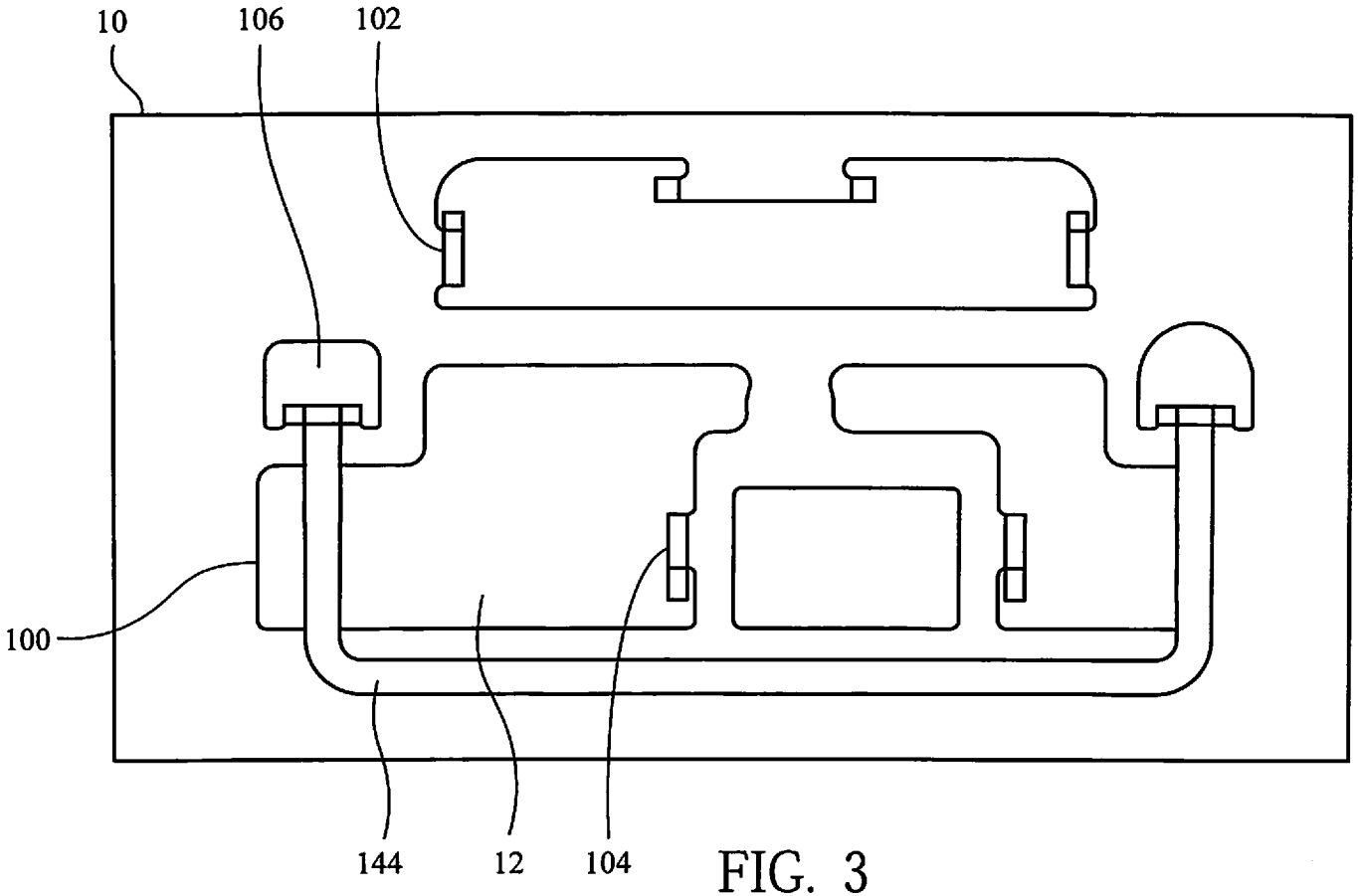
FIG. 3 is a partial top view of the base plate in FIG. 1.
Figure 4:
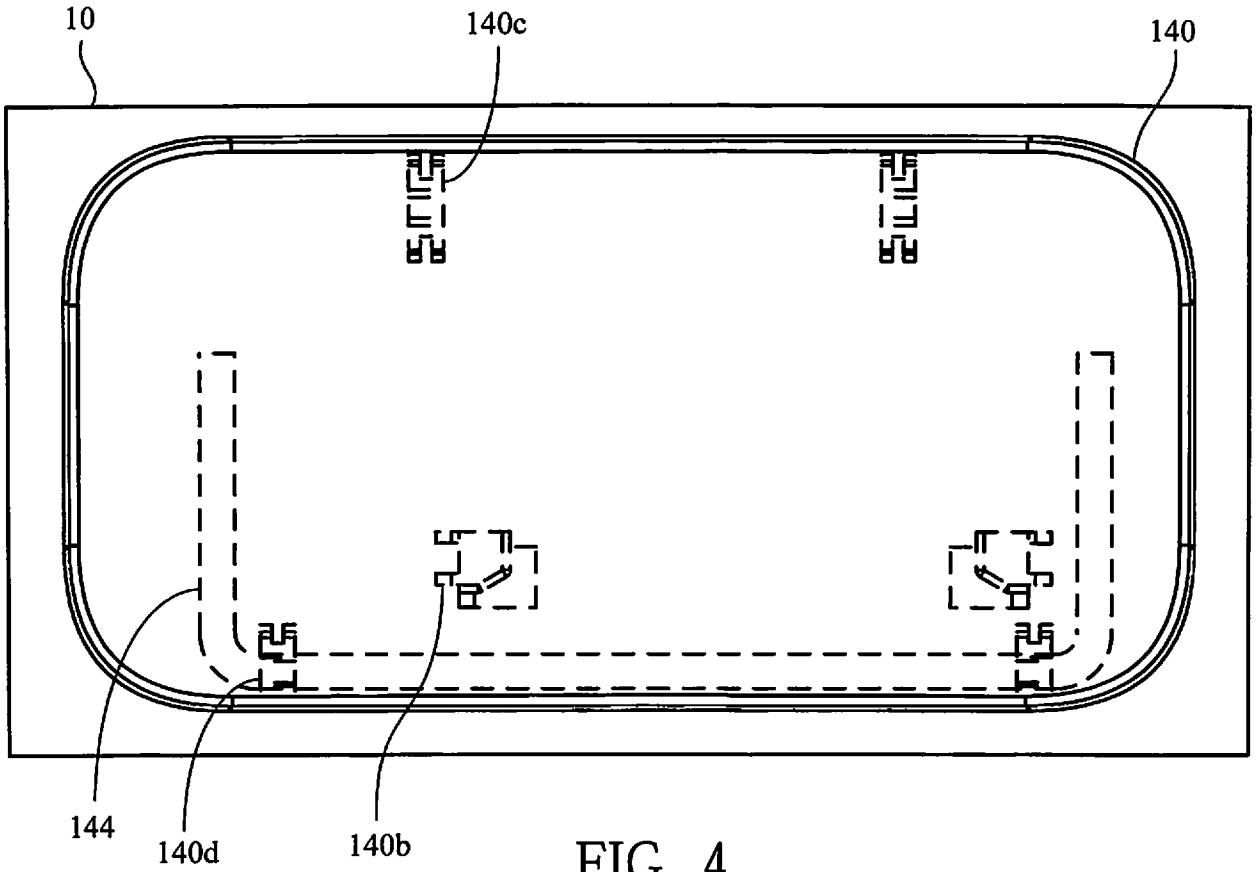
FIG. 4 is a top view of a keycap of the keyswitch in FIG. 1.

FIG. 3 is a partial top view of the base plate 10 in FIG. 1. FIG. 4 is a top view of the keycap 140 of the keyswitch 14 in FIG. 1.

As shown in FIG. 3, the base plate 10 of the keyboard 1 includes a first lower engaging portion 102 and a second lower engaging portion 104. The first lower engaging portion 102 and the second lower engaging portion 104 of the base plate 10 are substantially arranged along a direction. As shown in FIG. 4, the bottom of the keycap 140 of the keyswitch 14 includes a first upper engaging portion 140*b* and a second upper engaging portion 140*c*. The first upper engaging portion 140*b* and the second upper engaging portion 140*c* of the keycap 140 are substantially arranged along a direction.

Figure 5:
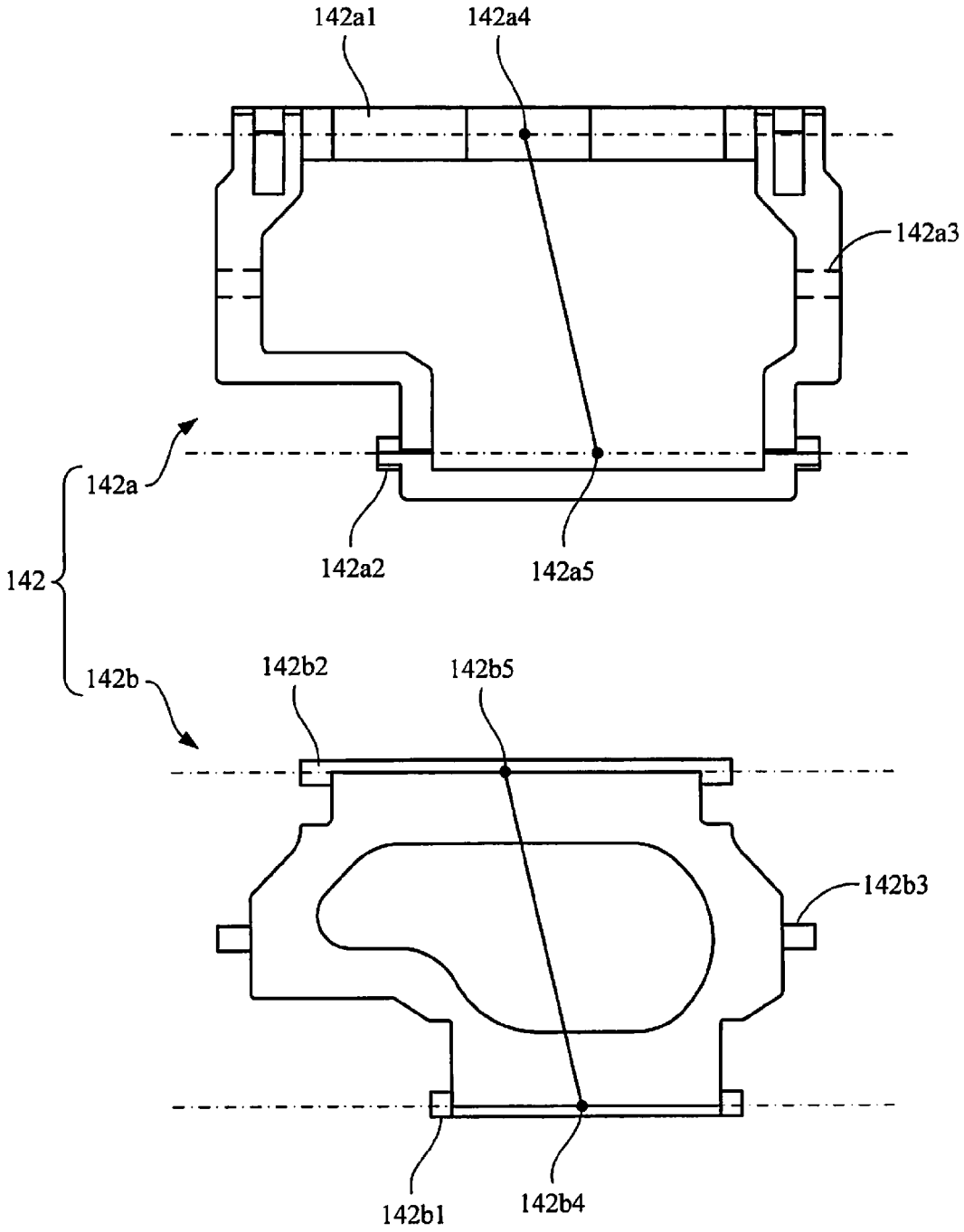
FIG. 5 is an exploded view of a scissors-like supporting structure of the keyswitch in FIG. 1.
Figure 6:
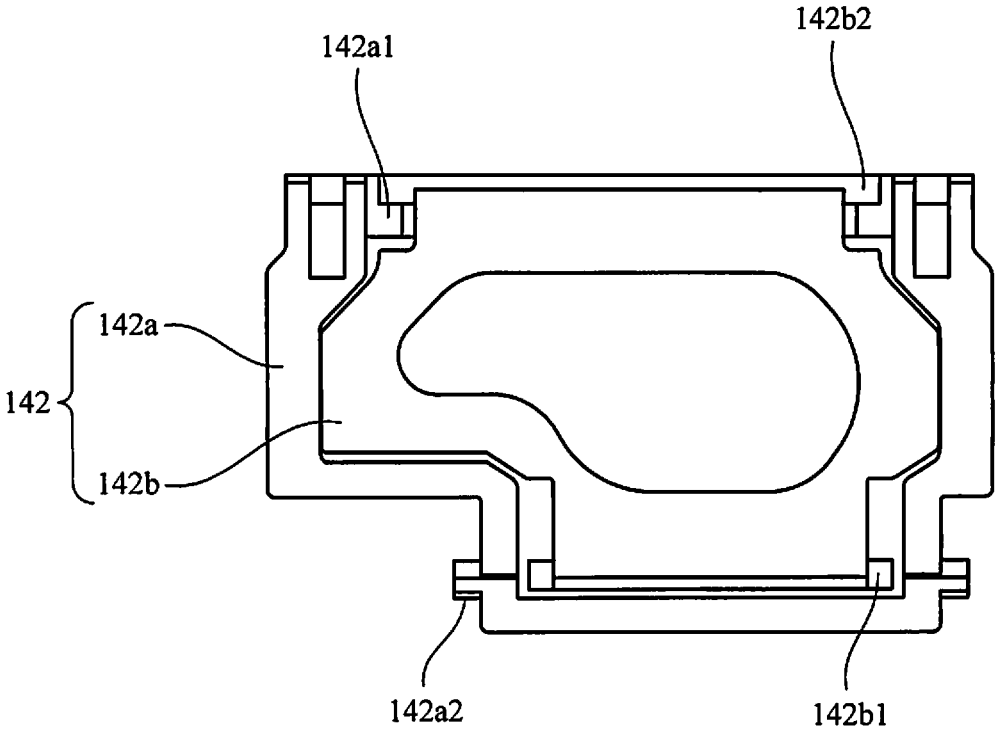
FIG. 6 is an assembled view of the scissors-like supporting structure in FIG. 5.

FIG. 5 is an exploded view of a scissors-like supporting structure 142 of the keyswitch 14 in FIG. 1. FIG. 6 is an assembled view of the scissors-like supporting structure 142 in FIG. 5.

As shown in FIG. 5 and FIG. 6, each of the keyswitches 14 of the keyboard 1 further includes a scissors-like supporting structure 142. The scissors-like supporting structure 142 of the keyswitch 14 is disposed on the base plate 10 of the keyboard 1 and supports the keycap 140 of the keyswitch 14. The scissors-like supporting structure 142 of the keyswitch 14 includes a first supporting member 142*a* and a second supporting member 142*b*. Both the first supporting member 142*a* and the second supporting member 142*b* of the scissors-like supporting structure 142 are roughly circular in shape, and the shape and size of the first supporting member 142*a* are such that the first supporting member 142*a* follows along and surrounds the periphery of the second supporting member 142*b* (i.e., the size of the first supporting member 142*a* is larger than the size of the second supporting member 142*b*). The first supporting member 142*a* of the scissors-like supporting structure 142 has two coaxial pivotal holes 142*a*3, and the pivotal holes 142*a*3 are respectively located at inner walls of two opposite edges of the first supporting member 142*a*. The second supporting member 142*b* of the scissors-like supporting structure 142 has two coaxial pivotal rods 142*b*3, and the pivotal rods 142*b*3 are respectively located at outer walls of two opposite edges of the second supporting member 142*b*. When the first supporting member 142*a* surrounds the periphery of the second supporting member 142*b*, the pivotal holes 142*a*3 of the first supporting member 142*a* can be pivotally connected with the pivotal rods 142*b*3 of the second supporting member 142*b* (i.e., the pivotal holes 142*a*3 of the first supporting member 142*a* and the pivotal rods 142*b*3 of the second supporting member 142*b* are coaxial after assembly). Therefore, the second supporting member 142*b* with a smaller size can rotate at the inner edge of the first supporting member 142*a*.

As shown in FIG. 5 and also in FIG. 3 and FIG. 4, the first supporting member 142*a* of the scissors-like supporting structure 142 includes a first engaging shaft 142*a*1 and a second engaging shaft 142*a*2, and the first engaging shaft 142*a*1 and the second engaging shaft 142*a*2 are respectively located at the upper side and the lower side of the first supporting member 142*a*. The first engaging shaft 142*a*1 of the first supporting member 142*a* can be engaged with the first lower engaging portion 102 of the base plate 10, and the second engaging shaft 142*a*2 of the first supporting member 142*a* can be engaged with the first upper engaging portion 140*b* of the keycap 140. Furthermore, the second supporting member 142*b* of the scissors-like supporting structure 142 includes a third engaging shaft 142*b*1 and a fourth engaging shaft 142*b*2, and the third engaging shaft 142*b*1 and the fourth engaging shaft 142*b*2 are respectively located at the upper side and the lower side of the second supporting member 142*b*. The third engaging shaft 142*b*1 of the second supporting member 142*b* can be engaged with the second lower engaging portion 104 of the base plate 10, and the fourth engaging shaft 142*b*2 of the second supporting member 142*b* can be engaged with the second upper engaging portion 140*c* of the keycap 140.

In order to ensure that the keycap 140 can vertically move relative to the base plate 10 when the keyswitch 14 is pressed, the first engaging shaft 142*a*1 of the first supporting member 142*a* and the fourth engaging shaft 142*b*2 of the second supporting member 142*b* are slidably engaged with the first lower engaging portion 102 of the base plate 10 and the second upper engaging portion 140*c* of the keycap 140 respectively, and the second engaging shaft 142*a*2 of the first supporting member 142*a* and the third engaging shaft 142*b*1 of the second supporting member 142*b* are pivotally connected to the first upper engaging portion 140*b* of the keycap 140 and the second lower engaging portion 104 of the base plate 10 respectively.

Alternatively, in another embodiment of the disclosure, the first engaging shaft 142*a*1 of the first supporting member 142*a* and the fourth engaging shaft 142*b*2 of the second supporting member 142*b* are pivotally connected to the first lower engaging portion 102 of the base plate 10 and the second upper engaging portion 140*c* of the keycap 140 respectively, and the second engaging shaft 142*a*2 of the first supporting member 142*a* and the third engaging shaft 142*b*1 of the second supporting member 142*b* are slidably engaged with the first upper engaging portion 140*b* of the keycap 140 and the second lower engaging portion 104 of the base plate 10 respectively. Such a configuration can also make the keycap 140 vertically move relative to the base plate 10 when the keyswitch 14 is pressed.

As shown in FIG. 5, a line that is connected between the center of gravity 142*a*4 of the first engaging shaft 142*a*1 and the center of gravity 142*a*5 of second engaging shaft 142*a*2 is not perpendicular to the axial direction of the first engaging shaft 142*a*1 and the axial direction of the second engaging shaft 142*a*2, and the length of the first engaging shaft 142*a*1 is greater than the length of the second engaging shaft 142*a*2. That is, the shapes of the upper side and the lower side (i.e., the first engaging shaft 142*a*1 and the second engaging shaft 142*a*2) of the first supporting member 142*a* of the scissors-like supporting structure 142 are asymmetric. Similarly, a line that is connected between the center of gravity 142*b*4 of the third engaging shaft 142*b*1 and the center of gravity 142*b*5 of fourth engaging shaft 142*b*2 is not perpendicular to the axial direction of the third engaging shaft 142*b*1 and the axial direction of the fourth engaging shaft 142*b*2, and the length of the fourth engaging shaft 142*b*2 is larger than the length of the third engaging shaft 142*b*1. That is, the shapes of the upper side and the lower side (i.e., the third engaging shaft 142*b*1 and the fourth engaging shaft 142*b*2) of the second supporting member 142*b* of the scissors-like supporting structure 142 are asymmetric. It can be clearly seen that each of the lower-left corner of the first supporting member 142*a* and the lower-left corner of the second supporting member 142*b* of the scissors-like supporting structure 142 has an inwardly recessed shape.

Figure 7:
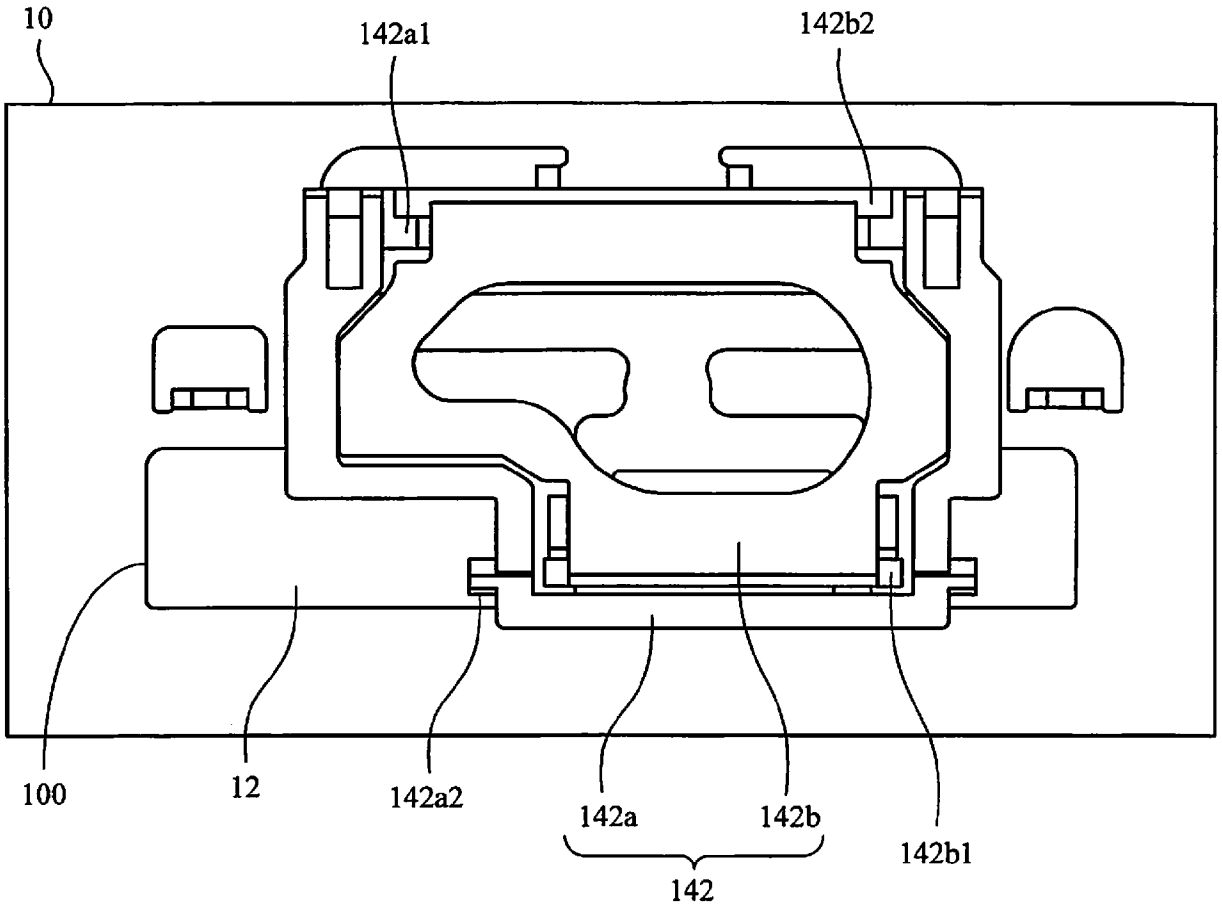
FIG. 7 is a top view of a portion of the base plate and the scissors-like supporting structure of the keyswitch in FIG. 1.
Figure 8:
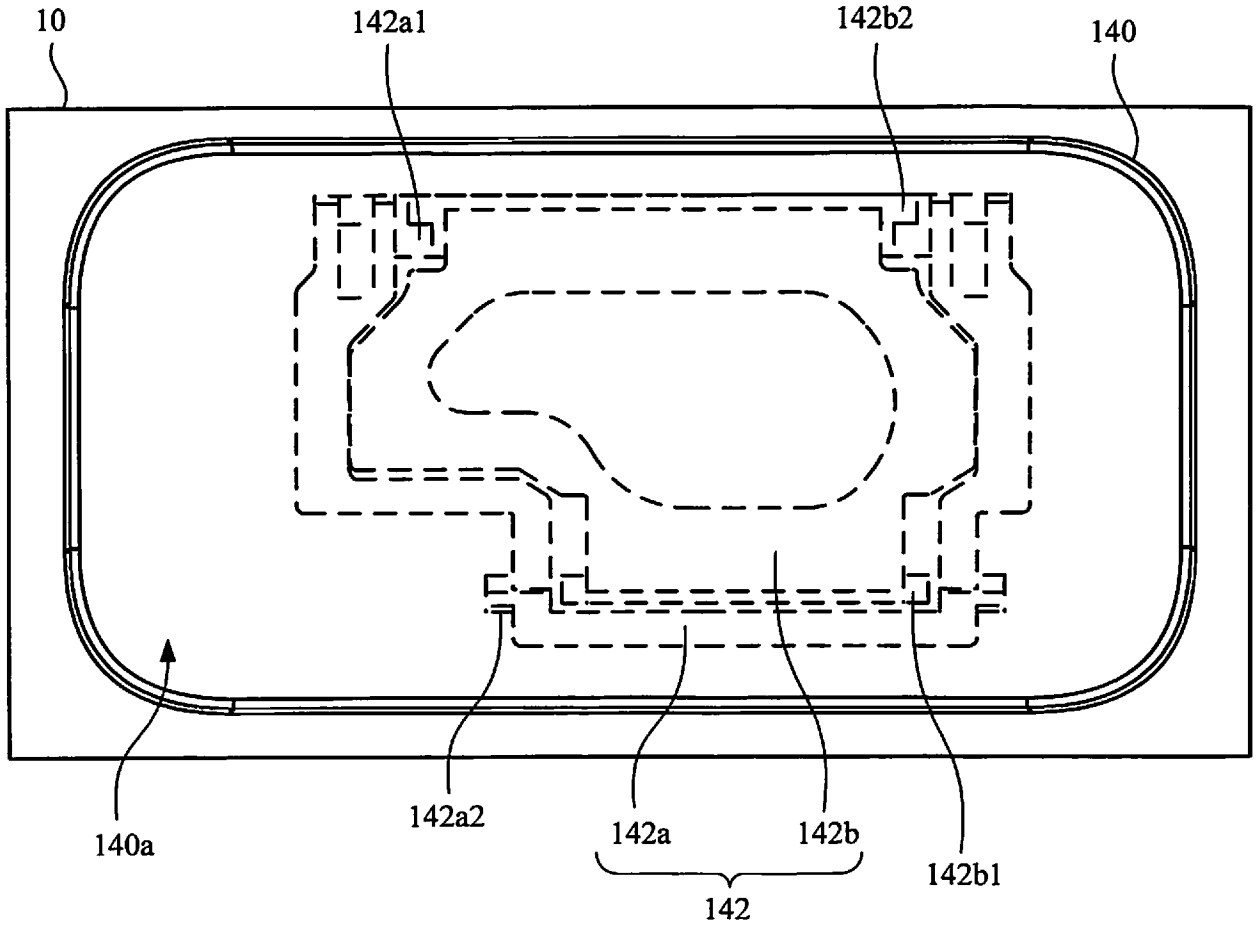
FIG. 8 is another top view of the keyswitch in FIG. 1, in which the scissors-like supporting structure is indicated by dotted lines.

FIG. 7 is a top view of a portion of the base plate 10 and the scissors-like supporting structure 142 of the keyswitch 14 in FIG. 1. FIG. 8 is another top view of the keyswitch 14 in FIG. 1, in which the scissors-like supporting structure 142 is indicated by dotted lines.

As shown in FIG. 7, the inwardly recessed shapes respectively located at the lower-left corners of the first supporting member 142*a* and the second supporting member 142*b* of the scissors-like supporting structure 142 are aligned with the light pervious region 140*a* of the keycap 140. Accordingly, the first supporting member 142*a* and the second supporting member 142*b* of the scissors-like supporting structure 142 do not occupy the space above the hole 100 of the base plate 10, so the light emitted by the light source 12 that is disposed under the base plate 10 is not obscured by the first supporting member 142*a* and the second supporting member 142*b* of the scissors-like supporting structure 142 and can be transmitted to the keycap 140. Furthermore, the length of the third engaging shaft 142*b*1 of the second supporting member 142*b* is smaller than the length of the first engaging shaft 142*a*1 of the first supporting member 142*a*, and the third engaging shaft 142*b*1 is closer to the hole 100 of the base plate 10 than the first engaging shaft 142*a*1. That is, the length of the third engaging shaft 142*b*1 of the second supporting member 142*b* is smaller, so the third engaging shaft 142*b*1 and the hole 100 of the base plate 10 can be arranged at the same side (i.e., the lower side in FIG. 7) and opposite to the first engaging shaft 142*a*1 of the first supporting member 142*a*.

As shown in FIG. 8, the inwardly recessed shapes respectively located at the lower-left corners of the first supporting member 142*a* and the second supporting member 142*b* of the scissors-like supporting structure 142 are aligned with the light pervious region 140*a* of the keycap 140 (i.e., the hole 100 of the base plate 10 is aligned with the light pervious region 140*a* of the keycap 140). Accordingly, the first supporting member 142*a* and the second supporting member 142*b* of the scissors-like supporting structure 142 do not occupy the space under the light pervious region 140*a* of the keycap 140, so the light emitted by the light source 12 that is disposed under the base plate 10 is not obscured by the first supporting member 142*a* and the second supporting member 142*b* of the scissors-like supporting structure 142 and can be transmitted to the keycap 140. Furthermore, the length of the second engaging shaft 142*a*2 of the first supporting member 142*a* is smaller than the length of the fourth engaging shaft 142*b*2 of the second supporting member 142*b*, and the second engaging shaft 142*a*2 is closer to the light pervious region 140*a* of the keycap 140 than the fourth engaging shaft 142*b*2. That is, the length of the second engaging shaft 142*a*2 of the first supporting member 142*a* is smaller, so the second engaging shaft 142*a*2 and the light pervious region 140*a* of the keycap 140 can be arranged at the same side (i.e., the lower side in FIG. 8) and opposite to the fourth engaging shaft 142*b*2 of the second supporting member 142*b*.

Because the keyswitch 14 of the disclosure adopts the asymmetric scissors-like supporting structure 142 to provide support under the keycap 140, the stability of vertical movement of the keycap 140 relative to the base plate 10 may be adversely affected. In order to solve the problem of insufficient stability during vertical movement of the keycap 140 relative to the base plate 10, in an embodiment of the disclosure, a thickness of the keycap 140 of the keyswitch 14 is larger than 1 mm. In another embodiment of the disclosure, a thickness of the scissors-like supporting structure 142 of the keyswitch 14 is larger than 1.3 mm. However, the disclosure is not limited in this regard, and these dimensions can be adjusted according to practical requirements.

As shown in FIG. 3 and FIG. 4, the keyswitch 14 further includes a linkage member 144. The base plate 10 of the keyboard 1 further includes a third lower engaging portion 106, and the bottom of the keycap 140 further includes a third upper engaging portion 140*d*. The third upper engaging portion 140*d* of the keycap 140 is located at an edge of the bottom of the keycap 140. The linkage member 144 of the keyswitch 14 is engaged with the third lower engaging portion 106 of the base plate 10 and the third upper engaging portion 140*d* of the keycap 140, and assists to support the keycap 140 when the keycap 140 vertically moves relative to the base plate 10, so that the stability of vertical movement of the keycap 140 relative to the base plate 10 can be improved.

Figure 9:
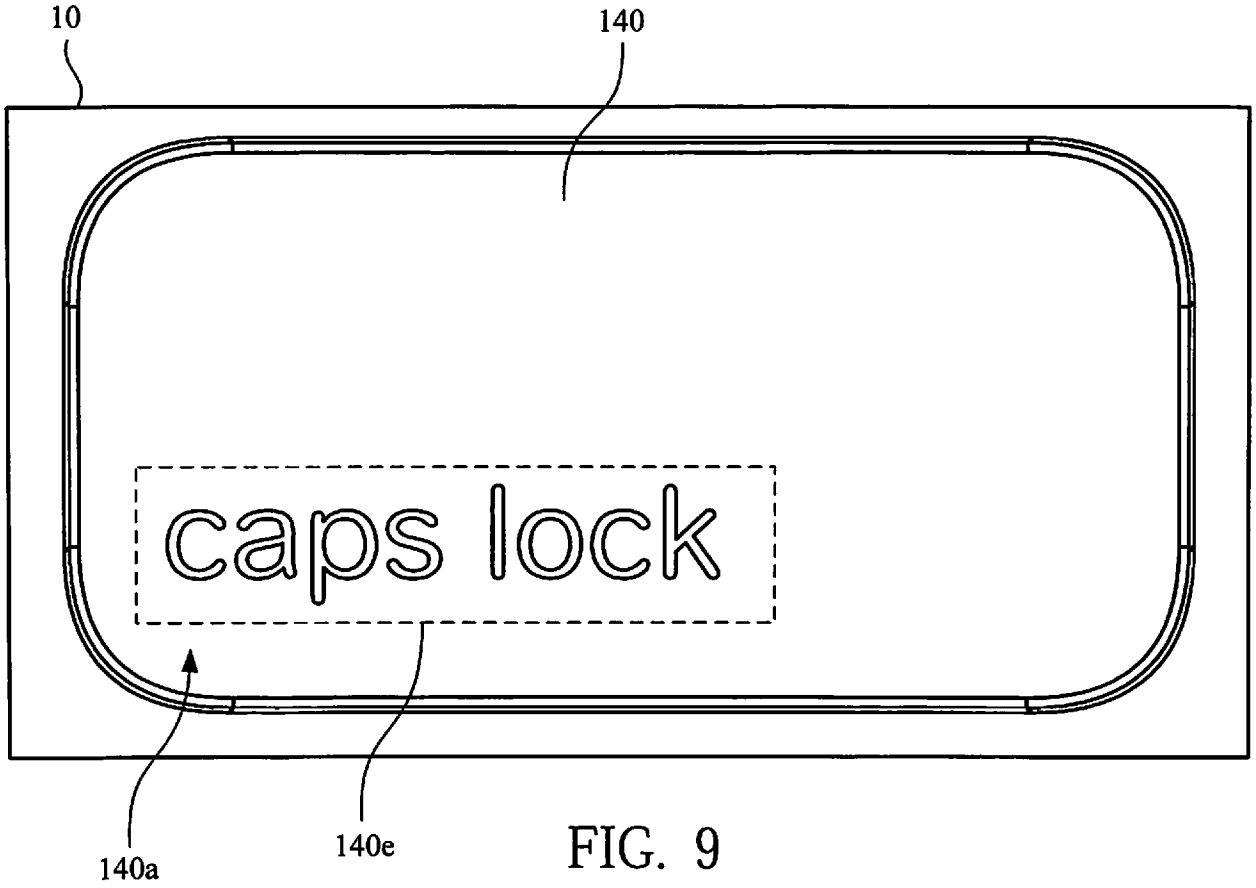
FIG. 9 is another top view of the keyswitch in FIG. 1.

FIG. 9 is another top view of the keyswitch 14 in FIG. 1.

As shown in FIG. 9, the keycap 140 of the keyswitch 14 can be made of a transparent material. The keycap 140 of the keyswitch 14 includes a laser inside-engraving layer 140*e* (e.g., the pattern "caps lock" in FIG. 9), and the laser inside-engraving layer 140*e* is substantially located at the light pervious region 140*a* that is aligned with the hole 100 of the base plate 10. Because the scissors-like supporting structure 142 does not occupy the space that is above the hole 100 of the base plate 10 and under the light pervious region 140*a* of the keycap 140, the light emitted by the light source 12 that is disposed under the base plate 10 is not obscured by the scissors-like supporting structure 142 and can be transmitted to the pattern of the laser inside-engraving layer 140*e* of the keycap 140. Therefore, the display result of the pattern is visually appealing and easily recognized by users.

In an embodiment of the disclosure, the pattern included in the laser inside-engraving layer 140*e* of the keycap 140 can be a number, a symbol, a word, or a figure, but the disclosure is not limited in this regard.

According to the foregoing recitations of the embodiments of the disclosure, it can be seen that the keyswitch of the disclosure adopts an asymmetric scissors-like supporting structure to provide support under a keycap, so that a certain portion (e.g., a corner of the keycap) is not occupied by the scissors-like supporting structure. Accordingly, the light emitted by a light source that is disposed at the bottom of the keyswitch is not obscured by the scissors-like supporting structure and can be transmitted to a pattern of a laser inside-engraving layer in a light pervious region of the keycap. Therefore, the display result of the pattern is visually appealing and easily recognized by users. Because the keyswitch adopts the asymmetric scissors-like supporting structure, the disclosure further improves the stability of the keycap during vertical movement by increasing the thickness of the keycap and the thickness of the scissors-like supporting structure, and additionally by disposing a linkage member for providing additional support to the keycap.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyswitch disposed on a base plate, the keyswitch comprising:

a keycap having a light pervious region; and a scissors-like supporting structure disposed on the base plate and supporting the keycap, the scissors-like supporting structure comprising:

a first supporting member comprising a first engaging shaft and a second engaging shaft that are respectively engaged with the base plate and the keycap, wherein a line connected between the centers of gravity of the first engaging shaft and second engaging shaft is not perpendicular to the axial direction of the first engaging shaft and the axial direction of the second engaging shaft; and a second supporting member pivotally connected to the first supporting member and comprising a third engaging shaft and a fourth engaging shaft that are respectively engaged with the base plate and the keycap, wherein a line connected between the centers of gravity of the third engaging shaft and fourth engaging shaft is not perpendicular to the axial direction of the third engaging shaft and the axial direction of the fourth engaging shaft, wherein the length of the third engaging shaft is smaller than the length of the first engaging shaft, the third engaging shaft is closer to the light pervious region than the first engaging shaft, the length of the second engaging shaft is smaller than the length of the fourth engaging shaft, and the second engaging shaft is closer to the light pervious region than the fourth engaging shaft.

2. The keyswitch of claim 1, wherein the length of the first engaging shaft is larger than the length of the second engaging shaft, and the length of the fourth engaging shaft is larger than the length of the third engaging shaft.

3. The keyswitch of claim 1, wherein the keycap has a light pervious region, and both of the first supporting member and the second supporting member have an inwardly recessed shape at a location corresponding to the light pervious region.

4. The keyswitch of claim 1, wherein a thickness of the keycap is larger than 1 mm.

5. The keyswitch of claim 1, wherein a thickness of the scissors-like supporting structure is larger than 1.3 mm.

6. The keyswitch of claim 1, further comprising a linkage member engaged with the base plate and an edge of the keycap.

7. The keyswitch of claim 1, wherein the keycap comprises a laser inside-engraving layer located at the light pervious region.

8. A keyboard comprising:

a base plate having a plurality of holes;

a light source disposed under the base plate, the light source emitting light via the holes; and a plurality of keyswitches disposed on the base plate, each of the keyswitches comprising:

a keycap having a light pervious region corresponding to the light source; and a scissors-like supporting structure disposed on the base plate and supporting the keycap, the scissors-like supporting structure comprising:

a first supporting member comprising a first engaging shaft and a second engaging shaft that are respectively engaged with the base plate and the keycap, wherein a line connected between the centers of gravity of the first engaging shaft and second engaging shaft is not perpendicular to the axial direction of the first engaging shaft and the axial direction of the second engaging shaft; and a second supporting member pivotally connected to the first supporting member and comprising a third engaging shaft and a fourth engaging shaft that are respectively engaged with the base plate and the keycap, wherein a line connected between the centers of gravity of the third engaging shaft and fourth engaging shaft is not perpendicular to the axial direction of the third engaging shaft and the axial direction of the fourth engaging shaft, wherein the length of the third engaging shaft is smaller than the length of the first engaging shaft, the third engaging shaft is closer to the light pervious region than the first engaging shaft, the length of the second engaging shaft is smaller than the length of the fourth engaging shaft, and the second engaging shaft is closer to the light pervious region than the fourth engaging shaft.

9. The keyboard of claim 8, wherein the length of the first engaging shaft is larger than the length of the second engaging shaft, and the length of the fourth engaging shaft is larger than the length of the third engaging shaft.

10. The keyboard of claim 8, wherein both of the first supporting member and the second supporting member have an inwardly recessed shape at a location corresponding to the light pervious region.

11. The keyboard of claim 8, wherein a thickness of the keycap is larger than 1 mm.

12. The keyboard of claim 8, wherein a thickness of the scissors-like supporting structure is larger than 1.3 mm.

13. The keyboard of claim 8, further comprising a linkage member engaged with the base plate and an edge of the keycap.

14. The keyboard of claim 8, wherein the keycap comprises a laser inside-engraving layer located at the light pervious region.

* * * * *